US007607742B2

(12) United States Patent
Oh et al.

(10) Patent No.: US 7,607,742 B2
(45) **Date of Patent: *Oct. 27, 2009**

(54) REFRIGERATOR HAVING BASKET LIFT APPARATUS

(75) Inventors: Seung-Hwan Oh, Gyeonggi-Do (KR); Kyung-Han Jeong, Seoul (KR); Sang-Oh Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 482 days.

This patent is subject to a terminal disclaimer.

(21) Appl. No.: 11/024,821

(22) Filed: Dec. 30, 2004

(65) Prior Publication Data

US 2006/0042303 A1 Mar. 2, 2006

(30) Foreign Application Priority Data

Aug. 26, 2004 (KR) ..... 10-2004-0067605

(51) Int. Cl.
*A47B 96/04* (2006.01)
*A47B 95/02* (2006.01)

(52) U.S. Cl. ..... 312/402; 312/404; 312/319.5

(58) Field of Classification Search ..... 312/404, 312/401, 400, 402, 330.1, 319.1–319.9, 304, 312/306, 307, 21–30, 223.2, 234.44; 108/144.11, 108/145–148; 62/407; 188/171, 161, 163, 188/322.5; 192/143, 144; 310/77, 93, 94; 74/49, 50, 55, 53, 411.5, 89.17, 422
See application file for complete search history.

(56) References Cited

U.S. PATENT DOCUMENTS 869,735 A * 10/1907 Rubin ..... 312/334.32
2,497,734 A * 2/1950 Kuklich ..... 312/312
2,769,676 A * 11/1956 Larsen et al. ..... 312/306
2,855,262 A 10/1958 Sharpe
2,861,857 A * 11/1958 Lee et al. ..... 312/312
2,932,404 A * 4/1960 Vershbow ..... 211/59.3
3,033,636 A 5/1962 Wurtz et al.
3,763,968 A * 10/1973 Noly ..... 188/171
4,568,132 A * 2/1986 Watt ..... 312/312
4,790,611 A * 12/1988 Craner ..... 312/306
4,811,820 A * 3/1989 Rossi ..... 188/71.6
5,154,261 A * 10/1992 Tanaka et al. ..... 188/171
5,429,043 A * 7/1995 Becker ..... 99/448
6,161,659 A * 12/2000 Maurice ..... 188/171

(Continued)

FOREIGN PATENT DOCUMENTS

DE 24 61 853 A1 7/1976

(Continued)

*Primary Examiner*—Janet M Wilkens
*Assistant Examiner*—Timothy M Ayres
(74) *Attorney, Agent, or Firm*—Birch, Stewart, Kolasch & Birch, LLP

(57) ABSTRACT

A refrigerator having a basket lift apparatus comprises: a body having cooling chambers for storing food; a basket accommodated in the cooling chamber arranged at a lower portion of the body in a slidable manner back and forth; a basket lift apparatus installed at the basket, for lifting the basket when the basket is drawn out; and a break unit for locking the basket when the basket is lifted to the maximum and thereby preventing the basket from being descended. When the basket is lifted to the maximum, a driving motor is locked thereby to prevent the basket from being descended.

22 Claims, 9 Drawing Sheets

U.S. PATENT DOCUMENTS

| | | | | |
|---|---|---|---|---|
| 6,321,883 | B1 * | 11/2001 | Pfann et al. | 188/161 |
| 6,483,217 | B1 * | 11/2002 | Roth-Stielow et al. | 310/93 |
| 2003/0173882 | A1 | 9/2003 | Koons | |
| 2005/0073225 | A1 | 4/2005 | Kwon et al. | |

FOREIGN PATENT DOCUMENTS

| | | | |
|---|---|---|---|
| DE | 297 01 227 | U1 | 6/1997 |
| JP | 05-296647 | A | 11/1993 |
| JP | 2001-91151 | A | 4/2001 |
| JP | 2001-280830 | A | 10/2001 |
| JP | 2001-343186 | A | 12/2001 |
| KR | 100159711 | B1 | 8/1998 |
| KR | 10-2004-0065760 | A | 7/2004 |

* cited by examiner

REFRIGERATOR HAVING BASKET LIFT APPARATUS

BACKGROUND OF THE INVENTION

1. Field of the Invention

The present invention relates to a refrigerator having a basket lift apparatus, and more particularly, to a refrigerator having a basket lift apparatus capable of enhancing a user's convenience by lifting a basket installed at a lower portion of a body when the basket is drawn out of a lower cooling chamber.

2. Description of the Conventional Art

FIG. 1 is a perspective view showing a refrigerator in accordance with the conventional art, and FIG. 2 is a sectional view of a refrigerator showing a state that a basket is accommodated in a body.

The conventional refrigerator comprises: a body 102 having an opened front side and an accommodation space; an upper cooling chamber 106 arranged at an upper side of the body 102 and having a pair of upper doors 104 opened to both sides, for storing food; and a lower cooling chamber 112 arranged at a lower side of the body 102, separated from the upper cooling chamber 106 by a partition wall 108, and having a lower door 110 opened in a slidable manner.

A mechanical chamber 116 having a compressor 114 for generating cold air to be supplied to the upper cooling chamber 106 and the lower cooling chamber 112, etc. is installed at a rear side of the body 102.

A basket 120 for accommodating food is arranged at the lower cooling chamber 112 to be slidable back and forth, and the lower door 110 is fixed at a front side of the basket 120. According to this, when the lower door 110 is pulled, the basket 120 is opened, and when the lower door 110 is pushed, the basket 120 is closed. A guide rail 124 is installed between an inner side surface of the basket 120 and an inner side surface of the lower cooling chamber 112, thereby guiding the basket 120 to be slidable back and forth.

A plurality of drawers 126 for storing food are installed at an upper side of the basket 120 to be opened in a slidable manner.

In the conventional refrigerator, when a user forwardly pulls the lower door 110 in order to take out the food stored in the lower cooling chamber 112 or in order to accommodate food in the lower cooling chamber 112, the basket 120 is opened with a slide motion. Also, when the user backwardly pushes the lower door 110 after taking out the food stored in the basket 120 or accommodating food in the basket 120, the basket 120 is closed with a slide motion.

However, in the conventional refrigerator, since the basket is arranged at a lower portion of the refrigerator, the user has to bend his or her waist or has to crouch in order to take out the food stored in the basket or to accommodate food in the basket thereby to have inconvenience in using the basket.

SUMMARY OF THE INVENTION

Therefore, an object of the present invention is to provide a refrigerator having a basket lift apparatus capable of enhancing a user's convenience by lifting a basket installed at a lower portion of a body when the basket is drawn out of a lower cooling chamber.

Another object of the present invention is to provide a refrigerator having a basket lift apparatus capable of preventing a basket from being descended by fixing the basket when the basket is lifted to the maximum.

Still another object of the present invention is to provide a refrigerator having a basket lift apparatus capable of enhancing a user's convenience by fixing a basket to a desired height.

To achieve these and other advantages and in accordance with the purpose of the present invention, as embodied and broadly described herein, there is provided a refrigerator having a basket lift apparatus comprising: a body having cooling chambers for storing food; a basket accommodated in the cooling chamber arranged at a lower portion of the body in a slidable manner back and forth; a basket lift apparatus installed at the basket, for lifting the basket when the basket is drawn out; and a break unit for locking the basket when the basket is lifted to the maximum and thereby preventing the basket from being descended.

The basket lift apparatus includes: a lifting frame arranged at a rear surface of a door arranged at a front side of the basket to be movable up and down, and on which the basket is positioned; a lifting arm roll-motioned at a lower surface of the lifting frame and hinge-connected to the door, for lifting the lifting frame; a driving motor for rotating the lifting arm; and a control unit for controlling the driving motor when the basket is drawn out of the lower cooling chamber and thereby lifting the basket.

The control unit is composed of: lift switches adjusted by a user; a first sensor mounted at an upper end of the door, for sensing a state that the lifting frame is lifted to the maximum; a second sensor mounted at a lower end of the door, for sensing a state that the lifting frame is descended to the maximum; an on/off switch for cutting off power applied to the driving motor and the break unit when the basket is lifted so that a height of the basket can be controlled by a user's selection; and a controller for controlling an operation of the driving motor according to a signal applied from the lift switch, the first sensor, the second sensor, and the on/off switch.

The break unit is composed of: a housing having an accommodation space therein; a disc rotatably arranged in the housing and connected to a rotation shaft of the driving motor; a friction plate facing the disc and frictional with the disc; a spring for providing an elastic force to the frictional plate so that the friction plate can be frictional with the disc; and a magnetic force generating unit for generating a magnetic force so that the friction plate can be separated from the disc when power is supplied to the break unit.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

Hereinafter, a refrigerator having a basket lift apparatus will be explained in more detail with reference to the attached drawings.

Even if there may exist a plurality of preferred embodiments of the refrigerator having a basket lift apparatus according to the present invention, the most preferred embodiment will be explained hereinafter.

Figure 1:
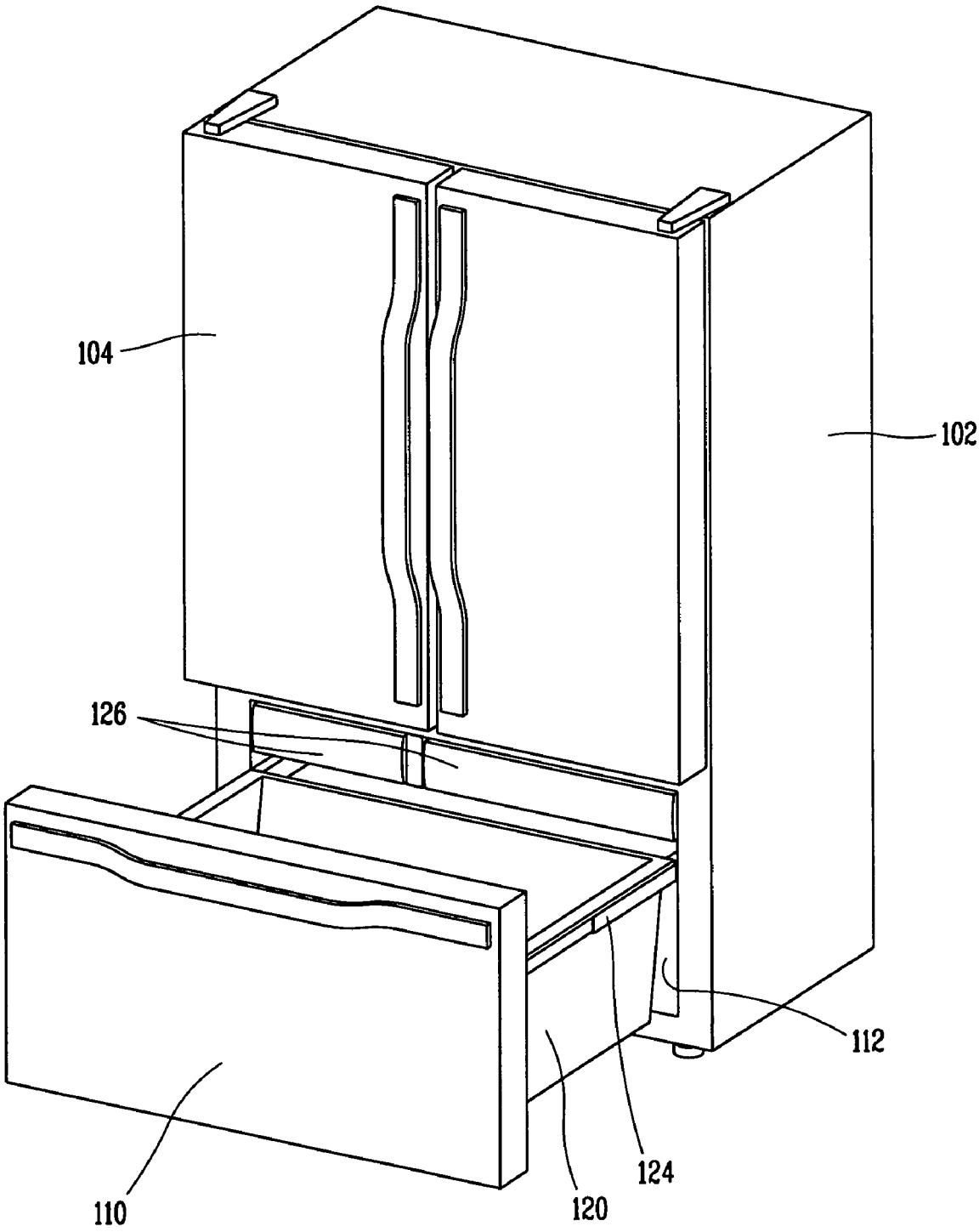
FIG. 1 CONVENTIONAL ART
FIG. 1 is a perspective view of a refrigerator in accordance with the conventional art.
Figure 2:
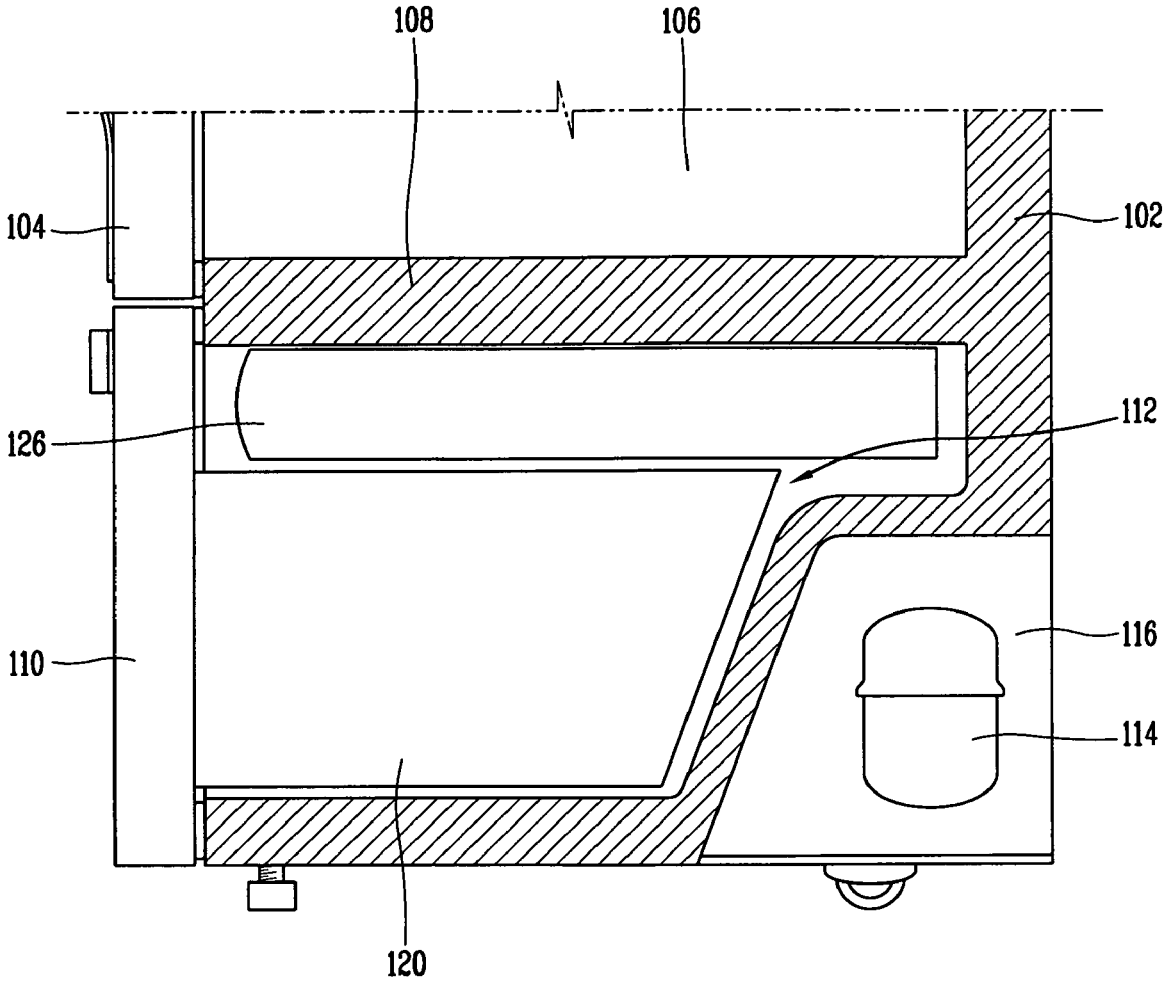
FIG. 2 CONVENTIONAL ART
FIG. 2 is a sectional view showing a lower portion of the refrigerator in accordance with the conventional art.
Figure 3:
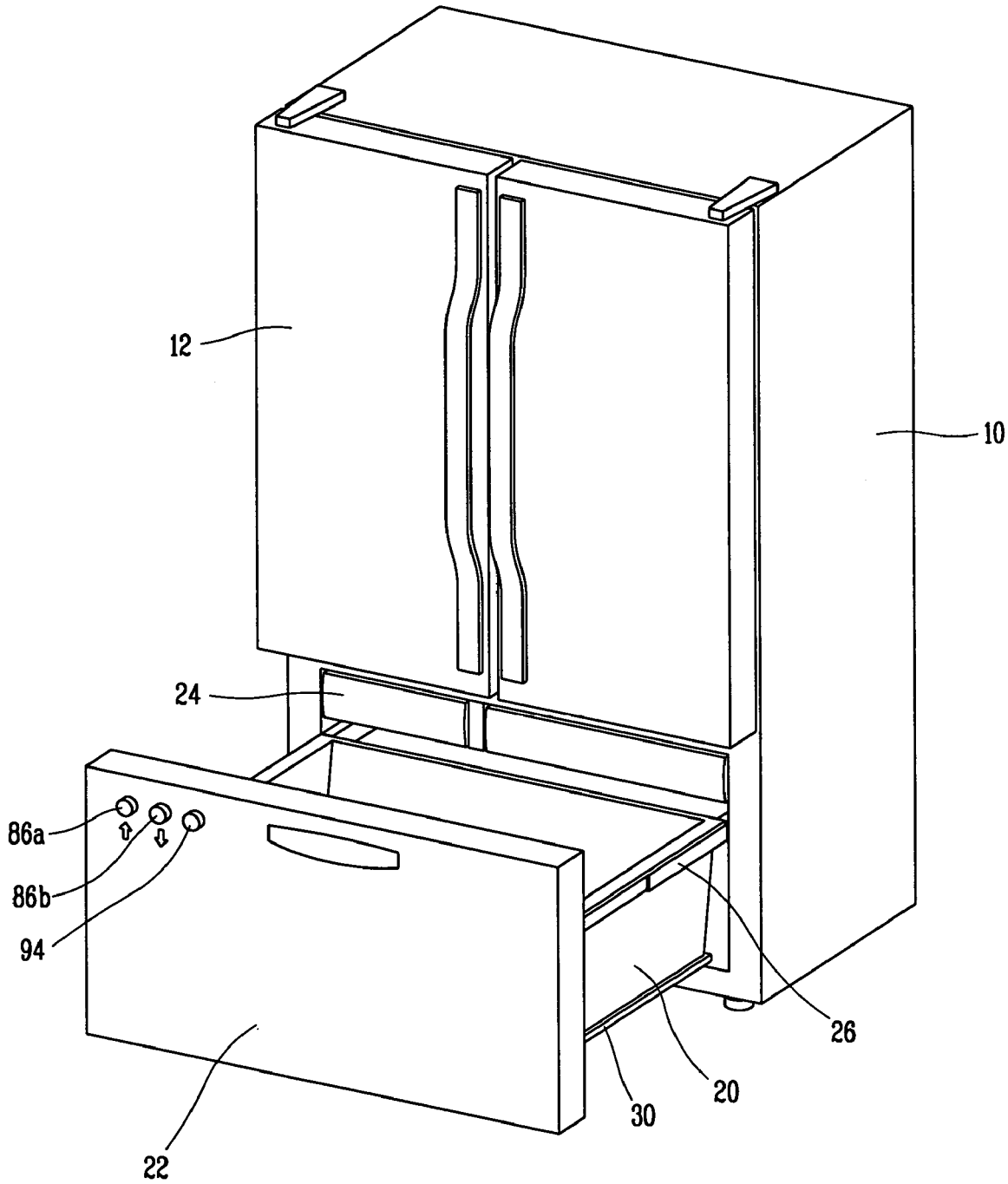
FIG. 3 is a perspective view of a refrigerator according to the present invention.
Figure 4:
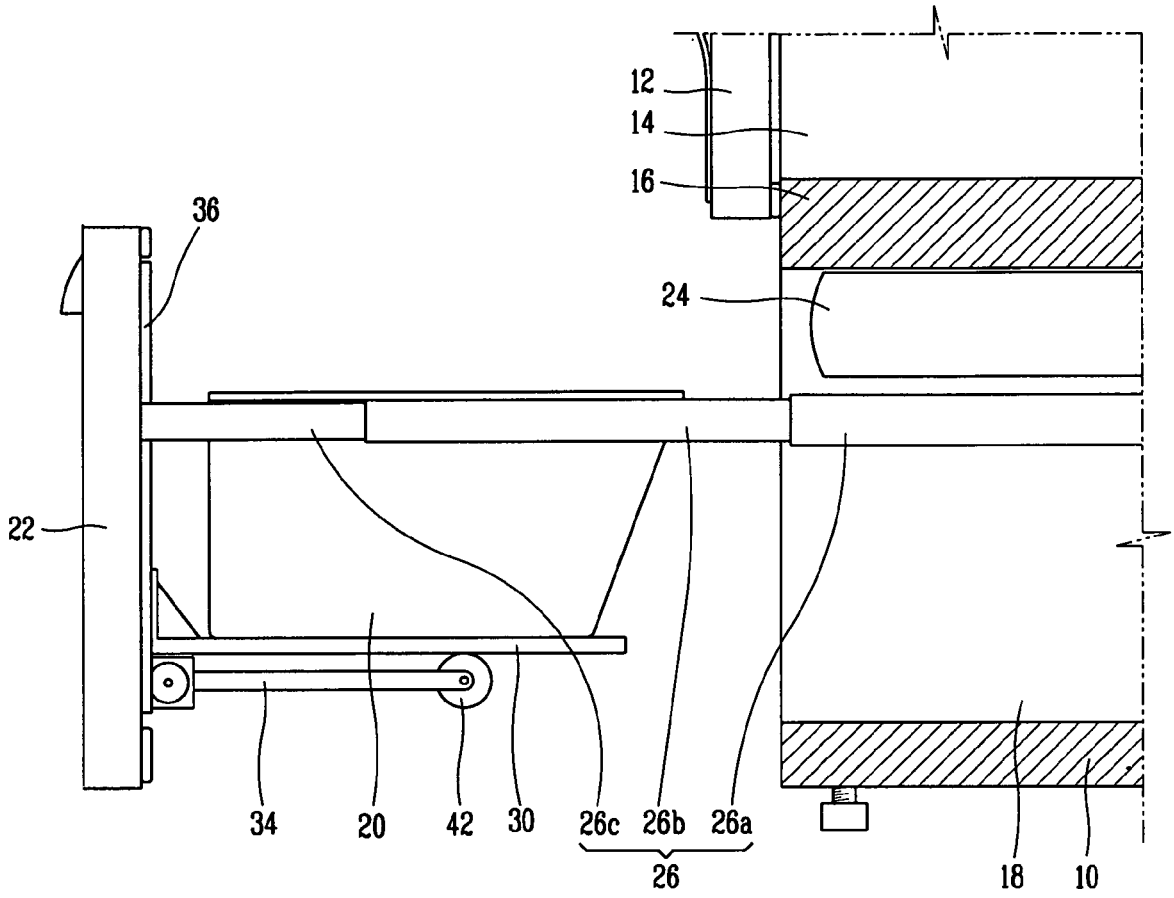
FIG. 4 is a sectional view of a basket lift apparatus of a refrigerator according to one embodiment of the present invention.

FIG. 3 is a perspective view of a refrigerator according to the present invention, and FIG. 4 is a sectional view showing a basket lift apparatus of the refrigerator according to the present invention.

The refrigerator according to the present invention comprises: a body 10 having an accommodation space; an upper cooling chamber 14 arranged at an upper side of the body 10 and having a pair of upper doors 12 opened to both sides; a lower cooling chamber 18 arranged at a lower side of the body 10 and separated from the upper cooling chamber 14 by a partition wall 16; a basket 20 arranged at the lower cooling chamber 18 to be slidable back and forth, for storing food; a basket lift apparatus for lifting the basket 20 when the basket 20 is drawn out of the lower cooling chamber 18; and a break unit 60 for fixing the basket 20 when the basket is lifted to the maximum by the basket lift apparatus and thereby preventing the basket 20 from being descended.

Preferably, the upper cooling chamber 14 is used as a cooling chamber for storing refrigerating food items, and the lower cooling chamber 18 is used as a freezing chamber for storing freezing food items.

A lower door 22 for pushing the basket 20 or drawing the basket 20 out of the lower cooling chamber 18 along back and forth directions of the body 10 is arranged at a front side of the lower cooling chamber 18. A plurality of drawers 24 drawn out along back and forth directions of the body 10 and for storing food are installed at an upper side of the lower cooling chamber 18.

A pair of guide rails 26 for guiding the lower door 22 to be slidable along back and forth directions of the body 10 is installed between both lateral surfaces of the lower cooling chamber 18 and a rear surface of the lower door 22.

The guide rail 26 is composed of: a fixed rail 26*a* fixed to both lateral surfaces of the lower cooling chamber 18; a middle rail 26*b* slidably connected to the fixed rail 26*a*; and a movable rail 26*c* slidably connected to the middle rail 26*b* and fixed to a rear surface of the lower door 22.

Figure 5:
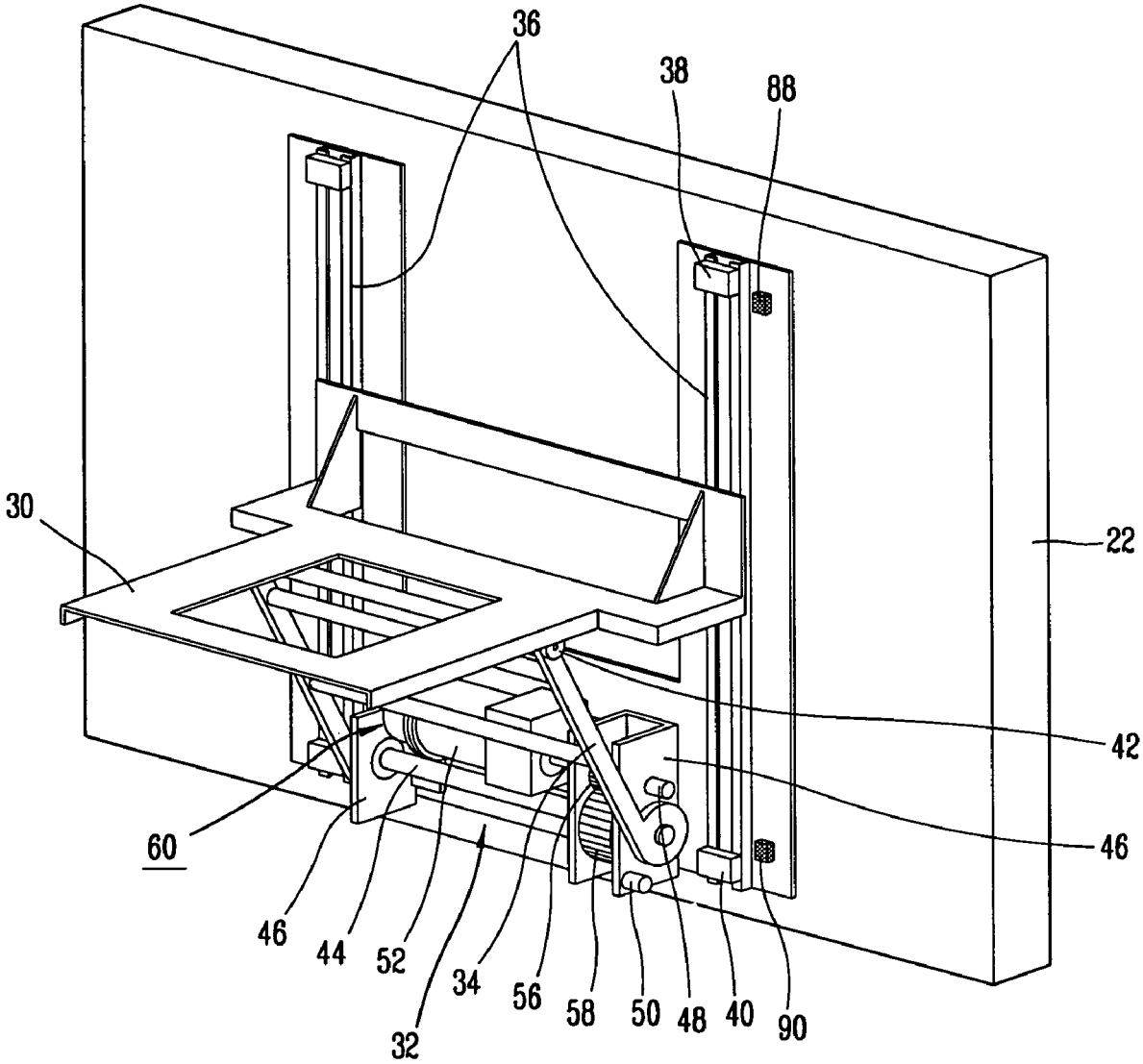
FIG. 5 is a perspective view of the basket lift apparatus of a refrigerator according to one embodiment of the present invention.
Figure 6:
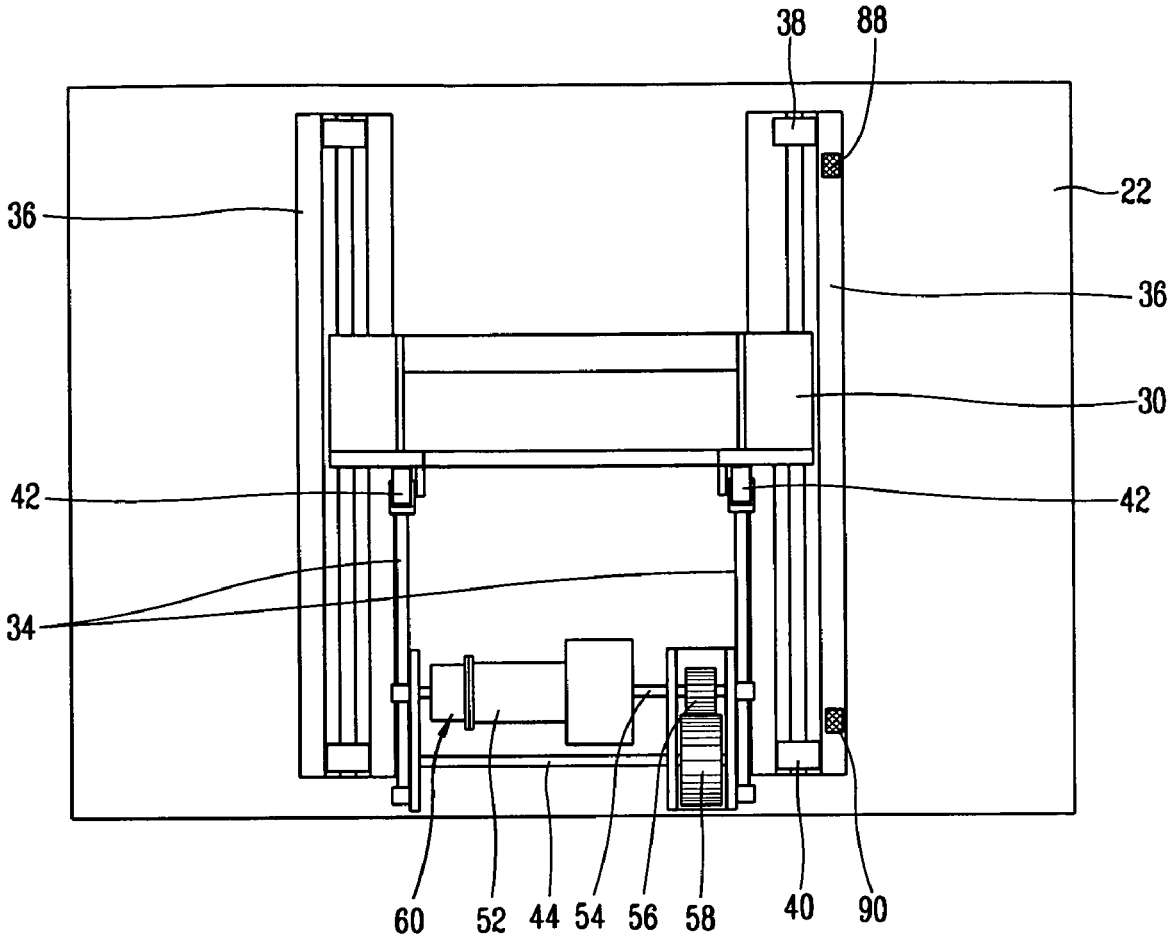
FIG. 6 is a frontal view of the basket lift apparatus of a refrigerator according to one embodiment of the present invention.

As shown in FIGS. 5 and 6, the basket lift apparatus includes: a lifting frame 30 arranged at a rear surface of the lower door 22 to be movable up and down, and on which the basket 20 is positioned; a lifting arm 34 roll-motioned at a lower surface of the lifting frame 30 and hinge-connected to the lower door 22, for lifting the lifting frame 30; a driving unit 32 for rotating the lifting arm 34; and a control unit for controlling the driving unit 32 when the basket 20 is drawn out of the lower cooling chamber 18 and thereby lifting the basket 20.

The lifting frame 30 is formed as a flat plate type so that the basket 20 can be positioned thereon. One side surface of the lifting frame 30 is bent as a right angle and is mounted at a rear surface of the lower door 22 to be movable up and down.

A pair of lifting rails 36 are fixed to the rear surface of the lower door 22 in a vertical direction, and the lifting frame 30 is mounted at the lifting rail 36 to be slidable up and down. As best seen in FIG. 6, a distance between the connection of the lifting frame 30 to the lifting rails 36 measured in a lateral direction of the lower door 22 is greater than a distance between the pair of lifting arms 34 measured in the lateral direction of the lower door 22.

An upper stopper 38 and a lower stopper 40 are respectively mounted at an upper end and a lower end of the lifting rail 36, thereby preventing the lifting frame 30 from being detached from the lower door 22.

A roller 42 roll-motioned at the lower surface of the lifting frame 30 is mounted at one end of the lifting arm 34, and a hinge shaft 44 is mounted at another end of the lifting arm 34. The hinge shaft 44 is rotatably supported at a supporting frame 46 fixed to the rear surface of the lower door 22.

A first stopper 48 and a second stopper 50 for limiting a rotation range of the lifting arm 34 are respectively formed at a lateral surface of the supporting frame 46.

The driving unit 32 is composed of: a driving motor 52 fixed to the rear surface of the lower door 22, and for rotating the lifting arm 34 and thereby lifting the lifting frame 30; and a power transmitting unit for transmitting a rotation force generated from the driving motor 52 to the lifting arm 34.

The power transmitting unit is composed of: a driving gear 56 fixed to a rotation shaft 54 of the driving motor 52 and arranged in the supporting frame 46; and a driven gear 58 gear-engaged with the driving gear 56 and fixed to the hinge shaft 44.

The break unit 60 locks the rotation shaft 54 of the driving motor 52 when the driving motor 52 is stopped as the basket 20 is lifted to the maximum, thereby preventing the basket 20 from being descended.

Figure 7:
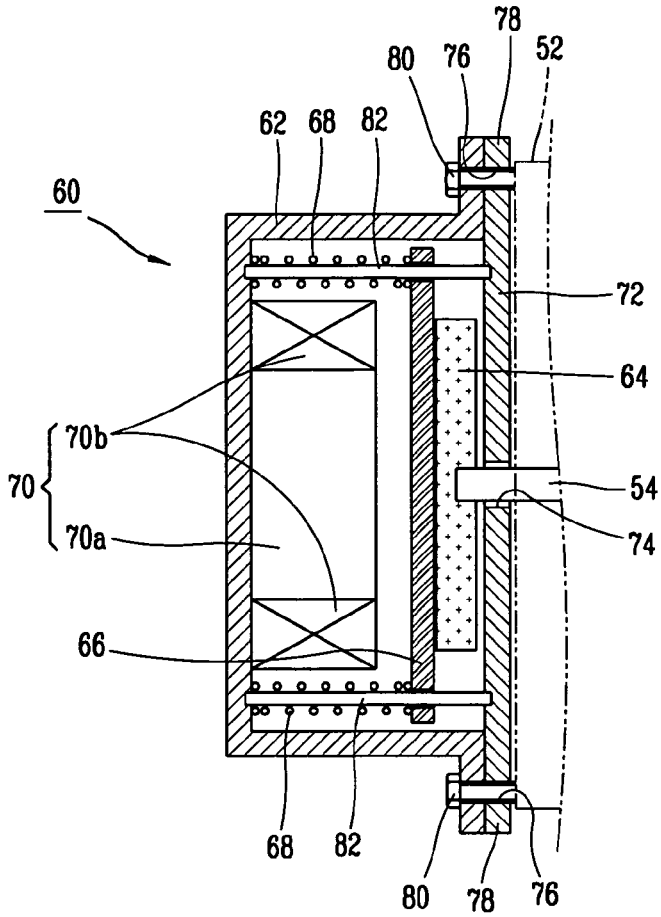
FIG. 7 is a sectional view showing a break unit of the basket lift apparatus of a refrigerator according to one embodiment of the present invention.

As shown in FIG. 7, the break unit 60 is composed of: a housing 62 fixed to one side surface of the driving motor 52 and having an accommodation space therein; a disc 64 rotatably arranged in the housing 62 and connected to the rotation shaft of the driving motor 52; a friction plate 66 facing the disc 64 and frictional with the disc 64; a spring 68 installed between a rear surface of the friction plate 66 and an inner wall surface of the housing 62, for providing an elastic force to the frictional plate 66 so that the friction plate 66 can be frictional with the disc 64; and a magnetic force generating unit 70 arranged in the housing 62, for generating a magnetic force so that the friction plate 66 can be separated from the disc 64 when power is supplied to the break unit.

The housing 62 is formed as a cylindrical shape having one open side, and a cover plate 72 is mounted at the open side. A penetration hole 74 for passing the rotation shaft 54 is formed in the middle of the cover plate 72. A flange 78 having a bolt-coupling hole 76 is formed at an outer circumferential surface of the housing 62, and is coupled to one side of the driving motor 52 by a bolt 80.

The disc 64 has a disc shape and to which the rotation shaft 54 that has been passed through the penetration hole 74 is fixed. The disc 64 is rotated together with the rotation shaft 54.

The friction plate 66 is formed of a magnetic substance that moves by a magnetic force, and supporting rods 82 for supporting the friction plate 66 to be movable in an axial direction is arranged at an edge of the friction plate 66. One end of the supporting rods 82 is fixed to an inner wall surface of the housing 62, and another end thereof is fixed to the cover plate 72. The spring 68 is wound on the supporting rod 82, thereby providing an elastic force to the friction plate 66 movably mounted at the supporting rod 82.

The magnetic force generating unit 70 is composed of: a core 70*a* facing the friction plate 66 with a certain interval and generating a magnetic force when power is supplied to the break unit; and a coil 70*b* wound on an outer circumferential surface of the core 70*a*.

As another embodiment of the break unit 60, differently from the aforementioned embodiment in which the break unit 60 is installed at the rotation shaft 54 of the driving motor 52, the break unit 60 is installed at the hinge shaft 44 to which the lifting arm 34 is connected and locks the hinge shaft 44, thereby preventing the basket 20 from being descended.

Figure 8:
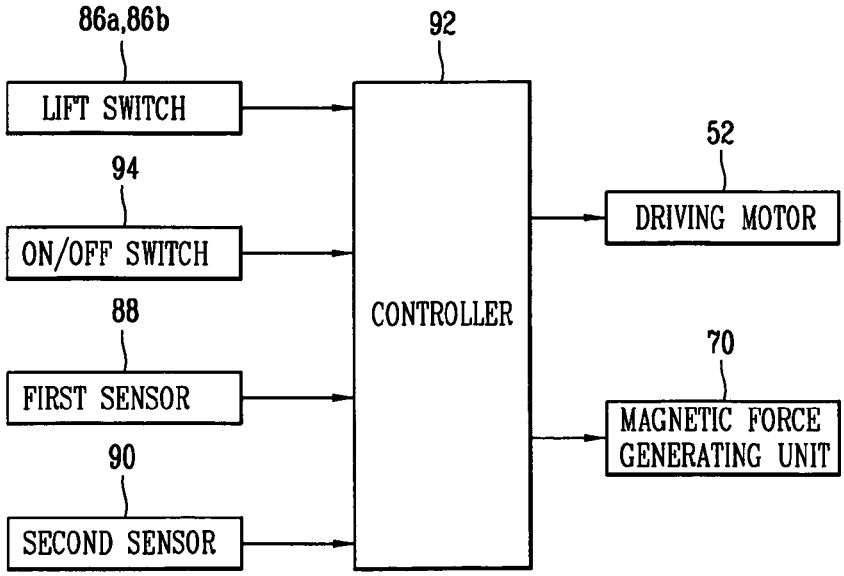
FIG. 8 is a block diagram showing the break unit of the basket lift apparatus of a refrigerator according to one embodiment of the present invention.

As shown in FIG. 8, the control unit is composed of: lift switches 86*a* and 86*b* adjusted by a user in order to lift the basket 20; a first sensor 88 mounted at an upper end of the lifting rail 36, for sensing a position that the lifting frame 30 is lifted to the maximum; a second sensor 90 mounted at a lower end of the lifting rail 36, for sensing a position that the lifting frame 30 is descended to the maximum; an on/off switch 94 for cutting off power applied to the driving motor 52 when the basket 20 is lifted so that the basket 20 can be fixed to a desired position by a user's selection; and a controller 92 for turning on/off power supplied to the driving motor 52 and the magnetic force generating unit 70 according to a signal applied from the lift switches 86*a* and 86*b*, the first sensor 88, the second sensor 90, and the on/off switch 94.

The lift switches are composed of: the first switch 86*a* mounted at a front surface of the lower door 22 and adjusted by the user when the lifting frame 30 is to be lifted up; and the second switch 86*b* mounted at the front surface of the lower door 22 and adjusted by the user when the lifting frame 30 is to be descended.

The first sensor 88 and the second sensor 90 are preferably constructed as a limit switch for applying a signal to the controller 92 at the time of being contact with the lifting frame 30 or the basket 20 positioned on the lifting frame 30, or are constructed as an optical sensor.

The on/off switch 94 is preferably installed at a front surface of the lower door 22. When power supplied to the driving motor 52 is cut off by adjusting the on/off switch 94 while the basket 20 is lifted, the break unit 60 is operated thereby to stop the basket 20. According to this, the user can stop the basket 20 at a desired height.

An operation of the basket lift apparatus according to the present invention will be explained as follows.

Figure 9:
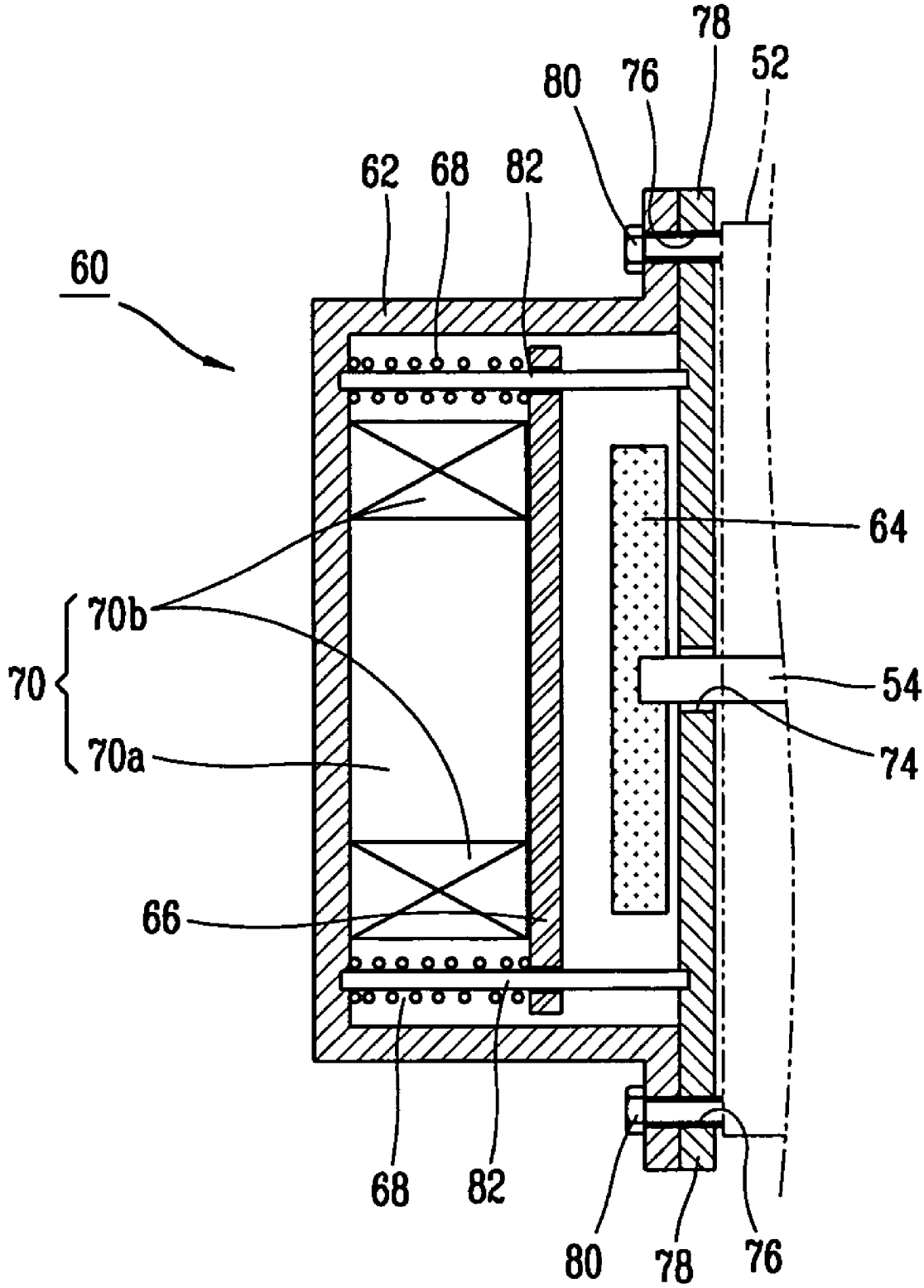
FIG. 9 is an operation state view of the break unit of the basket lift apparatus of a refrigerator according to one embodiment of the present invention.
Figure 10:
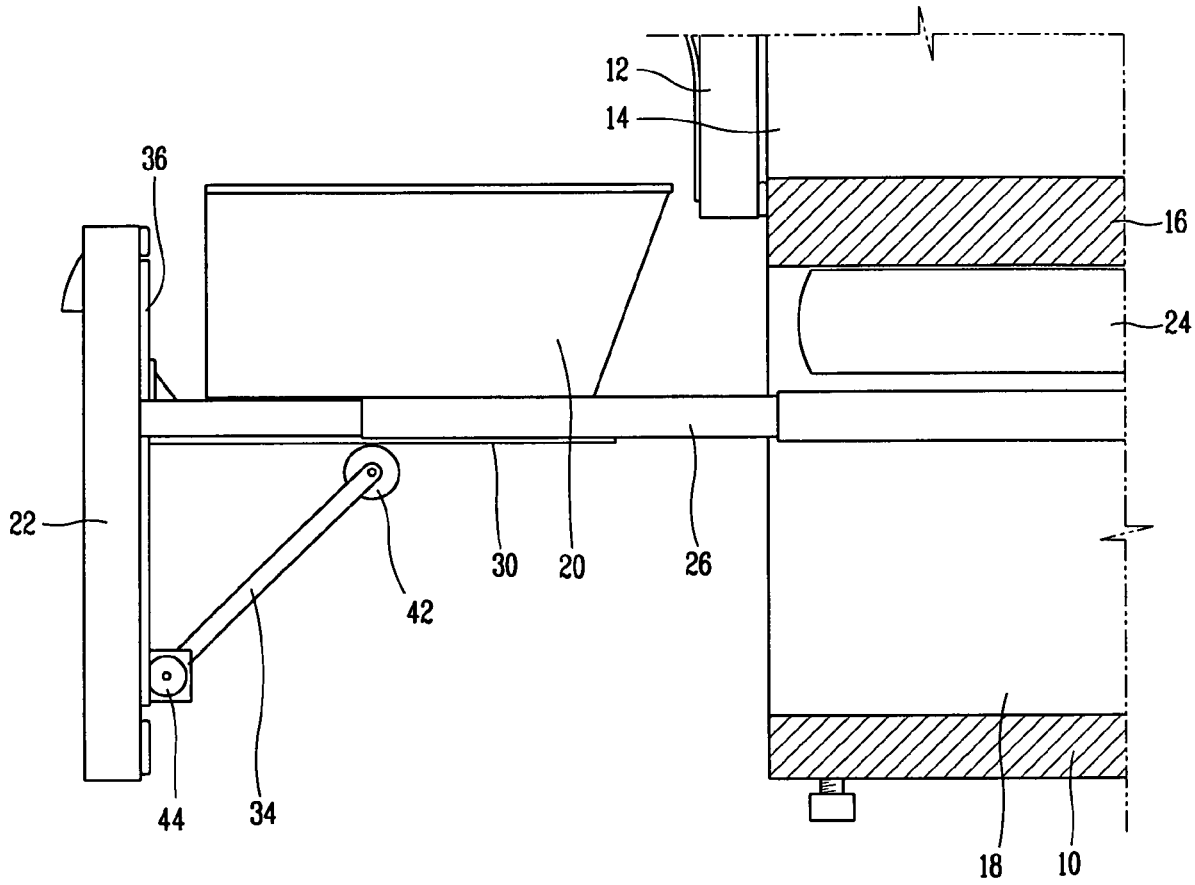
FIG. 10 is an operation state view of the basket lift apparatus of a refrigerator according to one embodiment of the present invention.

FIG. 9 is an operation state view of the break unit according to the present invention, and FIG. 10 is an operation state view of the basket lift apparatus according to the present invention.

The user forwardly pulls the lower door 22 in order to take out food stored in the basket 20 thereby to draw the basket 20 out of the lower cooling chamber 18, and then adjusts the first switch 86*a* mounted at the front surface of the lower door 22. According to this, a signal is applied to the controller 92 from the first switch 86*a*. Then, the controller 92 drives the driving motor 52 in a forward direction, and at the same time supplies power to the magnetic force generating unit 70.

According to this, the rotation shaft 54 of the driving motor 52 is rotated thus to rotate the driving gear 56 fixed to the rotation shaft 54, and thereby the driven gear 58 gear-engaged with the driving gear 56 is rotated thus to rotate the hinge shaft 44.

When power is supplied to the magnetic force generating unit 70, a magnetic force is generated. By the generated magnetic force, the friction plate 66 overcomes an elastic force of the spring 68 and linearly-moves, thereby being separated from the disc 64. According to this, the locking of the rotation shaft 54 of the driving motor 52 connected to the disc 64 is released.

When the hinge shaft 44 is rotated as the driving motor 52 is driven, the driving arm 34 fixed to the hinge shaft 44 is rotated. According to this, the roller 42 mounted at the lifting arm 34 is roll-motioned at the lower surface of the lifting frame 30 thereby to lift the lifting frame 30. When the lifting frame 30 is lifted to the maximum, the first sensor 88 senses the state and applies a signal indicating the signal to the controller 92. Then, the controller 92 cuts off the power supplied to the driving motor 52, and cuts off the power supplied to the magnetic force generating unit 70.

When the power supplied to the magnetic force generating unit 70 is cut off, the friction plate 66 is linearly moved by the elastic force of the spring 68 and becomes frictional with the disc 64 thereby to lock the disc 64. According to this, the rotation shaft 54 of the driving motor 52 connected to the disc 64 is locked and the lifting arm 34 connected to the rotation shaft 54 by the power transmitting unit is locked, thereby preventing the basket 20 from being descended.

Under this state, when the user adjusts the second switch 86*b* after storing food in the basket 20 or taking food out of the basket 20, the controller 92 supplies power to the driving motor 52 in a backward direction thereby to drive the driving motor 52 in a backward direction, and supplies power to the magnetic power generating unit 70.

By the magnetic force generated from the magnetic force generating unit 70, the friction plate 66 is separated from the disc 64 thereby to release the locking of the driving motor 52. The driving motor 52 is driven in a backward direction thereby to descend the lifting frame 30.

When the descent of the lifting frame 30 is completed, the second sensor 90 senses the state and applies a signal indicating the state to the controller 92. Then, the controller 92 cuts off the power supplied to the driving motor 52 and the magnetic force generating unit 70. The user backwardly pushes the lower door 22 thereby to accommodate the basket 20 in the lower cooling chamber 18.

If the user wants to change the height of the basket 20, the user adjusts the on/off switch 94 when the basket 20 reaches a desired position. According to this, the power supplied to the driving motor 52 and the magnetic force generating unit 70 is cut off, and thereby the driving motor 52 is stopped. At the same time, the friction plate 66 of the break unit 60 becomes frictional with the disc 64 and locks the driving motor 52, thereby locking the basket 20 at a desired height.

Effects of the refrigerator having a basket lift apparatus according to the present invention will be explained as follows.

When the basket is drawn out of the lower cooling chamber, the basket is lifted by using the basket lift apparatus provided at the basket. According to this, the user can take out food stored in the basket, and thereby the user's convenience is enhanced.

Also, the break unit for locking the rotation shaft of the driving motor is installed at the driving motor, and the driving motor is locked when the basket is lifted to the maximum, thereby preventing the basket from being descended.

Additionally, the on/off switch is turned off when the basket is lifted, and thereby the power supplied to the driving motor and the break unit is cut off. According to this, the basket is locked at a desired position thus to control the height of the basket by the user.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A refrigerator comprising:

a body having a cooling chamber;

a door arranged at a front side of the cooling chamber;

a basket arranged at the cooling chamber for storing food;

a basket lift apparatus for lifting the basket, the basket lift apparatus including:

a pair of lifting rails connected to the door;

a lifting frame movably connected to each of the pair of lifting rails and on which the basket is positioned;

a pair of driving arms, each driving arm being provided with a roller roll-mounted at a lower surface of the lifting frame at one end thereof, the pair of driving arms being connected by a hinge shaft extending therebetween, the hinge shaft being rotatably supported by a supporting frame fixed to a rear surface of the door; and a driving motor mounted at the door for rotating the pair of driving arms; and a brake unit for locking the basket and thereby preventing the basket from being lowered when the basket reaches a maximum position, wherein a distance between the connections of the lifting frame to the pair of lifting rails measured in a lateral direction of the door is greater than a distance between the pair of driving arms measured in the lateral direction of the door.

2. The refrigerator of claim 1, wherein the door is arranged at a front side of the cooling chamber and moved in back and forth directions.

3. The refrigerator of claim 2, wherein the basket lift apparatus further comprises a control unit for controlling the driving motor and thereby lifting the basket when the basket is drawn out.

4. The refrigerator of claim 3, wherein the control unit comprises:

a switch adjusted by a user;

a first sensor mounted at an upper end of the door for sensing a position that the lifting basket is lifted to the maximum;

a second sensor mounted at a lower end of the door for sensing a position that the lifting basket is descended to the maximum; and a controller for controlling the driving motor and the brake unit according to a signal applied from the switch, the first sensor, and the second sensor.

5. The refrigerator of claim 4, wherein the switch comprises:

a first switch mounted at the door and adjusted at the time of lifting the lifting frame; and a second switch mounted at the front surface of the door and adjusted at the time of lowering the lifting frame.

6. The refrigerator of claim 2, wherein the brake unit is mounted at the driving motor, and locks a rotation shaft of the driving motor thereby to prevent the basket from being lowered when the basket reaches a maximum position.

7. The refrigerator of claim 2, wherein the brake unit comprises:

a housing having a receiving space therein;

a disc rotatably arranged in the housing and connected to the rotation shaft of the driving motor;

a frictional plate facing the disc and frictional with the disc;

a spring for providing an elastic force to the frictional plate so that the frictional plate can be frictional with the disc; and a magnetic force generating unit for generating a magnetic force so that the frictional plate can be separated from the disc at the time of applying power.

8. The refrigerator of claim 7, wherein the frictional plate is linearly supported by a supporting rod so as to be movable in the housing in an axial direction.

9. The refrigerator of claim 8, wherein both ends of the supporting rod are fixed to an inner surface of the housing and the spring is wound on an outer circumferential surface of the supporting rod.

10. The refrigerator of claim 7, wherein the magnetic force generating unit is arranged with a certain interval from the frictional plate, and a coil is wound on an outer circumferential surface of a core for generating a magnetic force when power is applied thereto.

11. The refrigerator of claim 2, wherein the brake unit locks the hinge shaft to thereby prevent the basket from being lowered when the basket reaches a maximum position.

12. The refrigerator of claim 11, wherein the brake unit comprises:

a housing mounted at the door and having a receiving space therein;

a disc rotatably arranged in the housing and connected to the hinge shaft;

a frictional plate facing the disc and frictional with the disc;

a spring for providing an elastic force to the frictional plate so that the frictional plate can be frictional with the disc; and a magnetic force generating unit for generating a magnetic force so that the frictional plate can be separated from the disc at the time of applying power.

13. The refrigerator of claim 12, wherein the frictional plate is linearly supported by a supporting rod so as to be movable in the housing in an axial direction.

14. The refrigerator of claim 12, wherein both ends of the supporting rod is fixed to an inner surface of the housing and the spring is wound on an outer circumferential surface of the supporting rod.

15. The refrigerator of claim 12, wherein the magnetic force generating unit is arranged with a certain interval from the frictional plate, and a coil is wound on an outer circumferential surface of a core for generating a magnetic force when power is applied thereto.

16. A refrigerator comprising:

a body having a cooling chamber;

a door arranged at a front side of the cooling chamber;

a basket arranged at the cooling chamber for storing food;

a basket lift apparatus for lifting the basket, the basket lift apparatus including:

a pair of lifting rails connected to the door;

a lifting frame movably connected to each of the pair of lifting rails and on which the basket is positioned;

a pair of lifting arms, each lifting arm being provided with a roller roll-mounted at a lower surface of the lifting frame at one end thereof, the pair of lifting arms being connected by a hinge shaft extending therebetween, the hinge shaft being rotatably supported by a supporting frame fixed to a rear surface of the door; and a driving motor mounted at the door for rotating the pair of lifting arms;

a brake unit for locking the basket and thereby controlling a height of the basket when the basket reaches a desired position; and an on/off switch for operating the brake unit, wherein a distance between the connections of the lifting frame to the pair of lifting rails measured in a lateral direction of the door is greater than a distance between the pair of driving arms measured in the lateral direction of the door.

17. The refrigerator of claim 16, wherein the brake unit is mounted at the driving motor so as to control a height of the basket by locking a rotation shaft of the driving motor.

18. The refrigerator of claim 17, wherein the brake unit comprises:

a housing having a receiving space therein;

a disc rotatably arranged in the housing and connected to the rotation shaft of the driving motor;

a frictional plate facing the disc and frictional with the disc;

a spring for providing an elastic force to the frictional plate so that the frictional plate can be frictional with the disc; and a magnetic force generating unit for generating a magnetic force so that the frictional plate can be separated from the disc at the time of applying power.

19. The refrigerator of claim 18, wherein the frictional plate is linearly supported by a supporting rod so as to be movable in the housing in an axial direction.

20. The refrigerator of claim 19, wherein both ends of the supporting rod is fixed to an inner circumferential surface of the housing and the spring is wound on an outer circumferential surface of the supporting rod.

21. The refrigerator of claim 18, wherein the magnetic force generating unit is arranged with a certain interval from the frictional plate, and a coil is wound on an outer circumferential surface of a core for generating a magnetic force when power is applied thereto.

22. The refrigerator of claim 18, wherein the on/off switch is mounted at the door and turns on/off power applied to the magnetic force generating unit according to a user's adjustment.

* * * * *